US008434410B2

(12) United States Patent
AlSalem

(10) Patent No.: US 8,434,410 B2
(45) Date of Patent: May 7, 2013

(54) DEFORMABLE HIGH VOLOCITY BULLET

(76) Inventor: Salem A. S. AlSalem, Shamiya (KW)

( * ) Notice: Subject to any disclaimer, the term of this patent is extended or adjusted under 35 U.S.C. 154(b) by 100 days.

(21) Appl. No.: 12/968,384

(22) Filed: Dec. 15, 2010

(65) Prior Publication Data

US 2012/0152144 A1 Jun. 21, 2012

(51) Int. Cl.

| | |
|---|---|
| ***F42B 30/02*** | (2006.01) |
| ***F42B 5/02*** | (2006.01) |
| ***F42B 5/10*** | (2006.01) |
| ***F42B 10/00*** | (2006.01) |

(52) U.S. Cl.

USPC ..... 102/439; 102/507; 102/517; 102/518; 102/376

(58) Field of Classification Search ..... 102/501, 102/507, 508, 509, 510, 516, 517, 518, 374, 102/375, 376, 439, 519

See application file for complete search history.

(56) References Cited

U.S. PATENT DOCUMENTS

| | | | | |
|---|---|---|---|---|
| 4,136,616 | A | 1/1979 | Schirneker | |
| 4,216,722 | A * | 8/1980 | Angell | 102/491 |
| 4,964,339 | A * | 10/1990 | Bastian et al. | 102/376 |
| 4,974,517 | A | 12/1990 | Kraft et al. | |
| 5,016,538 | A | 5/1991 | Sowash | |
| 5,291,833 | A | 3/1994 | Boual | |
| 5,388,524 | A * | 2/1995 | Strandli et al. | 102/529 |
| 6,494,140 | B1 * | 12/2002 | Webster | 102/374 |
| 6,845,717 | B1 | 1/2005 | Sauvestre | |
| 6,971,315 | B2 | 12/2005 | Knappworst | |
| 7,299,750 | B2 * | 11/2007 | Schikora et al. | 102/506 |
| 7,380,502 | B2 | 6/2008 | Emary | |
| H2262 | H * | 9/2011 | Nechitailo | 102/517 |
| 2006/0213105 | A1 * | 9/2006 | Cugliari | 42/1.01 |

* cited by examiner

*Primary Examiner* — James Bergin

(74) *Attorney, Agent, or Firm* — Lowe Hauptman Ham & Berner, LLP

(57) ABSTRACT

A round of ammunition for an assault rifle or the like includes a cartridge and a bullet or projectile. The cartridge includes a rear portion and a forward portion with a reduced diameter while the rear portion is dimensioned to fit into the breach of a rifle and defines a hollow chamber or interior volume for a mass of gun powder and primer. The forward portion of the cartridge joins a bullet. The bullet includes a bullet shaped rounded lead tip and an aerodynamically shaped forward portion including a tapered shell and a solid cylindrically shaped lead middle portion. The forward portion also includes an axial steel rod between the tip and the middle portion. The bullet also includes a rear portion including a tapered shell surrounding a second hollow chamber with a small opening in the distal part of the bullet.

2 Claims, 1 Drawing Sheet

DEFORMABLE HIGH VOLOCITY BULLET

FIELD OF THE INVENTION

This invention relates to a deformable high velocity bullet and more particularly to a round of ammunition for an assault rifle or the like.

BACKGROUND FOR THE INVENTION

Deformable and high velocity bullets are well know and have been in use for many years. For example, a U.S. patent of Schirneker, U.S. Pat. No. 4,136,616 discloses projectiles of the type used for hunting purposes which have a front part at least partially made of softer material that are spread out on hitting the body of an animal by the action of the point and the concave connecting curve connecting the point to a circumferential shoulder. These parts push the softer material of the front part almost radially outwards so that the softer material has a depth effect spread over a relatively wide radius. This produces the powerful shock effect required for hunting purposes. The softer material in the front part of the projectile may either be broken up into small pieces and forced into the body of the game or held together by a deformable jacket. Since the projectile is not subjected to compression and its tip therefore not inverted, a clean exit out of the body is ensured in spite of the greater radial depth effect due either to direct influence or to pressure waves.

A more recent U.S. patent of Knappworst et al., U.S. Pat. No. 6,971,315 also discloses a deformable bullet. As disclosed, deformable bullets from the prior art vary considerably in terms of the energy that they release in the target medium especially in the human body. Therefore, the invention disclosed provides that a bullet consists of a jacketless bullet body wherein a cavity extends centrally in relation to the longitudinal axis of the bullet in a tapered front part of the bullet body. The cavity consists of a cylindrical part and at least one conical part adjoining the cylindrical part that serves as a pusher that forces the projectile open forming the bullet tip and the pusher consists of a head which seals the opening of the cavity and a shaft which extends into the cavity.

Further a U.S. patent of Emary, U.S. Pat. No. 7,380,502 discloses a rifle cartridge with a bullet having a resilient pointed tip. As disclosed, a firearm cartridge with a bullet includes a body and a nose element. The body has a forward end and an opposed rear end with an intermediate cylindrical portion between the ends. The front end of the body defines a cavity that may have a cylindrical shape. The nose element is formed of a resilient material such as an elastomer, and has a first portion received in the cavity and a pointed second portion extending from the forward end of the body. The bullet may be received in a center fire rifle casing for safe use in a tubular magazine rifle, so that the resilient tip protects against discharge of an adjacent cartridge primer by absorbing energy of recoil or other impulse. The second portion of the tip has a small meplat, and is smoothly contoured with the exterior surface of the front of the bullet, to provide an increased ballistic coefficient.

Notwithstanding the above it is presently believed that there is a need and a potential commercial market for an improved deformable high velocity bullet for use in an assault rifle or the like. It is believed that there will be a demand for such bullets because they provide high velocity and at the same time good stopping power because of reduced drag and lighter weight as well as the deformable tip which opens up to increase the impact on a individual or animal. It is also believed that such bullets are of relatively light weight, have an aerodynamic forward and rear portion of the projectile and can be manufactured and sold at a competitive cost.

BRIEF SUMMARY OF THE INVENTION

In essence a deformable high velocity bullet in accordance with the present invention includes a rounded solid tip, an aerodynamically shaped forward portion defining a hollow chamber and a middle generally cylindrically shaped solid portion of lead of a pre-selected caliber. The bullet also includes a rear aerodynamically shaped portion that defines a second hollow chamber. The forward portion includes a tapered shell of copper or steel or similar material extending into the rounded tip and into the solid middle portion and surrounds the first hollow chamber in the forward portion. The forward portion also includes an axially extending rod which is in contact with and extending between a rear surface of the round tip and a front surface of the solid middle portion. The rear portion of the bullet also includes an outer tapered shell surrounding the second hollow chamber and extends from the solid middle portion to define a relatively small opening at a distal end of the bullet.

The invention also contemplates a round of ammunition for an assault rifle or the like wherein the round of ammunition includes a cartridge and a bullet or projectile fixed within a forward portion of the cartridge. The cartridge includes a rear portion and a forward portion having a reduced diameter for fitting into a barrel of a rifle while the rear portion is constructed and dimensioned to fit into a breach of a firearm and defines an interior volume. A mass of gun powder is contained in the interior volume as well as a primer pocket and a mass of primer disposed therein behind and in contact with the mass of gun powder and is adapted to receive an impact from a firing pin of a firearm to ignite the gun powder and propel a bullet through the barrel of a rifle. The bullet includes a rounded solid tip, an aerodynamically shaped forward portion defining a hollow chamber and a middle generally cylindrically shaped solid portion of a pre-selected caliber. In addition a rear aerodynamically shaped portion defines a second hollow chamber while the forward portion includes a tapered shell extending into the rounded tip and into the middle portion thereof and axially extendable rod extends between the tip and the middle portion while the rear portion includes an outer tapered shell surrounding the second hollow chamber and extending from the solid middle portion to define a relatively small opening at a distal end of the bullet. Thus, the gases from the ignition of the gun powder are entered into the second hollow opening and during the flight of the bullet escape therefrom to contribute to the propulsion of the bullet.

The invention will now be described in connection with the following drawings wherein like reference numerals have been used to identify like parts.

DESCRIPTION OF THE PREFERRED EMBODIMENTS OF THE INVENTION

Figure 1:
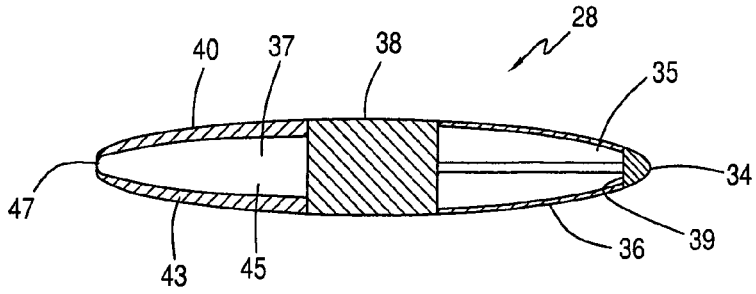
FIG. 1 is a cross sectional view of a bullet in accordance with a first embodiment of the invention.

The most common rounds of ammunition used in assault rifles in modern warfare are the 5.56×45 mm and 7.62×39 mm rounds both of which have weak points. For example, the 5.56×45 mm round is a bullet that maintains an aerodynamic shape and is of relatively light weight that is effective for flight but is less effective for impact or stopping power. By contrast, the weak point of the 7.62×39 mm round is that the bullet does not have a very aerodynamic shape and has a relatively heavy weight. This combination is not effective for flight but is effective for impact or stopping power. Neither of the aforementioned bullets have an aerodynamic rear portion, thus become slower in flight due to the presence of drag.

The High Velocity Collapsible bullet in accordance with the present invention maintains an aerodynamic shape on both ends of the projectile thus being efficient in flight because of reducing air residence. Furthermore, the aerodynamic rear portion of the High Velocity Collapsible bullet eliminated drag therefore allowing the projectile to maintain its speed due to the absence of drag which ordinarily would slow the projectile down. These features are absent in the 5.56×45 mm and 7.62×39 mm bullets.

The High Velocity Collapsible bullet in accordance with the present invention encompasses a second hollow chamber with an entrance or exit opening for the energy from the explosion in the cartridge to enter hence propelling the projectile. This chamber is located on the back end of the bullet and has a length of about ⅓ of the length of the bullet. The path between the hollow chamber to the entrance is at a 45 degree angle, thus when the propellant is ignited, the energy in the form of gas is directed into the hollow chamber through a metal reinforced opening not only propelling the projectile but also adding to the projectile speed in flight by the gases exiting from the exit hole thus acting as a secondary propellant. Also the first third of the bullet contains an empty first chamber that is encased in a thin layer shell that is strong enough to withstand the propellant explosion and flight. In addition, this chamber has a needle-like rod used for penetration on impact and is designed to be empty but can also host any number of explosives for a more volatile projectile. With or without explosives this shell includes an exterior layer that is designed to collapse on impact thus getting the target in contact with the middle third of the bullet to inflict maximum damage. These features are absent in both the 5.56×45 mm and 7.62×39 mm bullets.

Further, the High Velocity Collapsible round's cartridge is designed with a chamber in the rear to hold the propellant used to fire the projectile. This chamber is designed to direct the energy from the propellant explosion into the second hollow chamber. Further, a thin layer of plastic separates the cartridge chamber from the bullet chamber. These features are absent in both the 5.56×45 mm and 7.62×39 mm cartridges.

In theory the High Velocity Collapsible Round in accordance with the present invention is able to go further than both the 5.56×45 mm and 7.62×39 mm rounds due to its aerodynamic shape and the kinetic energy accommodating hollow ends. Also, the High Velocity Collapsible Round is able to produce more damage than either the 5.56×45 mm and 7.62×39 mm rounds due to its collapsible head and flat surface of the middle segment. In conclusion the High Velocity Collapsible Round in accordance with the present invention surpasses the range, speed and accuracy in the prior art bullets.

Figure 2:
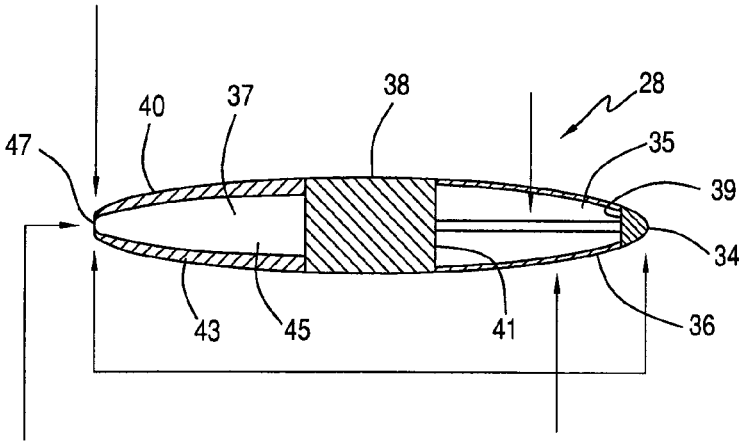
FIG. 2 is a cross sectional view of a bullet in accordance with the invention which illustrates the dimensions of various portions of the bullet.
Figure 3:
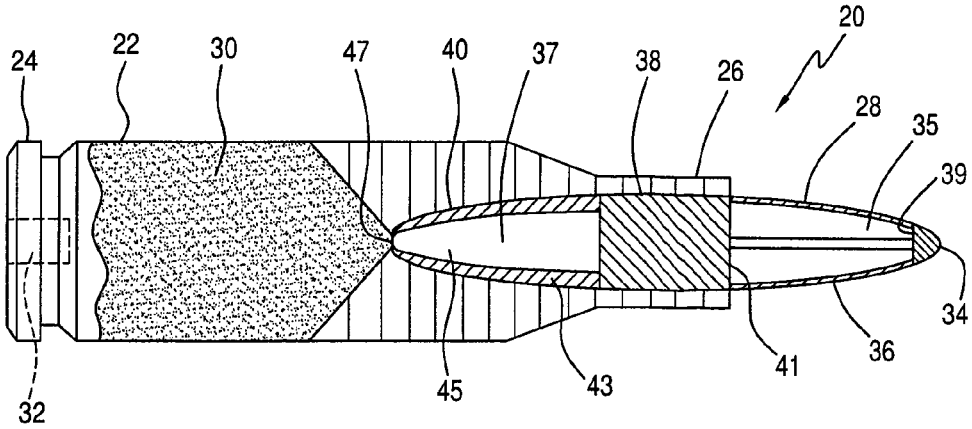
FIG. 3 is a cross sectional view of a cartridge in accordance with a second embodiment of the invention.

As illustrated in FIGS. 1-4, a round of ammunition 20 for an assault rifle includes a cartridge 22 having a rear portion 24 and a forward portion 26 with a bullet 28 or projectile joined to the forward portion 26. The rear portion 24 is constructed and dimensioned to fit into a barrel of a firearm (not shown). By contrast the forward portion is joined to the bullet and like the bullet is constructed and dimensioned to slide into the barrel of a rifle of a pre-selected caliber.

The rear portion 24 of the cartridge 22 defines an interior volume and a mass of gun powder 30 disposed within the interior volume together with a primer pocket 32 that is filled with primer and disposed behind the gun powder at the back of the cartridge 22. The primer pocket is adapted to receive an impact from a firing pin of a rifle to ignite the gun powder and propel the bullet out of the barrel.

The bullet 28 in accordance with a preferred embodiment of the invention includes a rounded tip 34 and aerodynamically shaped forward portion 36 defining a hollow chamber 35 and a generally cylindrical shaped middle portion 38 of a pre-selected caliber. The bullet 26 also includes a rear aerodynamically shaped portion 40 defining a second hollow chamber 37.

The forward aerodynamically shaped tapered portion 36 also includes an axial steel rod extending between a flat rear surface 39 of the tip 34 and a front surface 41 of the solid middle portion 38 aligned with a central longitudinal axis of the bullet 28. A rear portion 40 includes an outer tapered shell 43 that surrounds a second hollow chamber 45 in the rear portion 40 and extends from the solid middle portion to define a relatively small opening 47 at a distal end of the bullet 28. Upon firing the round of ammunition gases from the ignition of the gun powder infuse the second hollow chamber and as the bullet leaves the barrel of the firearm the gases in the second hollow chamber 45 escapes through the small opening 47 and contribute to the propulsion of the bullet. Further the first and second hollow chambers 35 and 45 reduce the weight of the bullet and therefore increase the speed of the bullet.

While the invention has been described in connection with its preferred embodiments it should be recognized that changes and modifications may be made therein without departing from the scope of the appended claims.

What is claimed is:

1. A deformable high velocity bullet, said bullet consisting of:

a rounded solid tip of lead having a generally rear flat surface, an aerodynamically shaped forward portion defining a hollow chamber, a middle substantially cylindrical shaped solid portion of a pre-selected caliber made of lead and a rear aerodynamically shaped portion defining a second hollow chamber and said forward portion including a tapered steel shell extending into said rounded tip and into said solid middle portion and surrounding said hollow chamber in said forward portion and an axially extending steel rod in contact with and extending between said rear flat surface of said rounded tip and said solid middle portion and said rear portion including an outer steel tapered shell surrounding said hollow chamber in said rear portion and defining a small opening at a distal end of said bullet and said outer steel tapered shell extending from said solid middle portion to said opening.

2. A round of ammunition for an assault rifle or the like, said round of ammunition consisting of:

a cartridge having a rear portion and a forward portion and a bullet attached to said forward portion of said cartridge and wherein said rear portion is constructed and dimensioned to fit into a barrel of a firearm and said forward portion is constructed and dimensioned to fit into the barrel of the firearm and wherein said rear portion defines an interior volume, a mass of gun powder contained in said interior volume of said rear portion, a primer pocket and a mass of primer disposed therein behind and in contact with said mass of gun powder and adapted to receive an impact from a firing pin to ignite said gun powder and said bullet adapted to be propelled out of said barrel by ignition of said gun powder and said bullet consisting of:

a rounded solid tip of lead having a generally flat rear surface, an aerodynamically shaped forward portion defining a first hollow chamber in said forward portion, a middle substantially cylindrical shaped solid portion of a pre-selected caliber made of lead and a rear aerodynamically shaped portion defining a second hollow chamber and said forward portion including a tapered steel shell extending into said rounded tip and into said solid middle portion and surrounding said first hollow chamber in said forward portion and an axially extending steel rod in contact with and extending between said rear flat surface of said rounded tip and said solid middle portion, and said rear portion including a second outer tapered steel shell surrounding said second hollow chamber and defining a small opening at a distal end of said bullet and said second outer tapered steel shell extending from said solid middle portion to said opening whereby gases infused into said second hollow chamber from ignition of said gun powder escape through said small opening at the distal end of said bullet to contribute to the propulsion of said bullet and wherein said bullet has the following dimensions, bullet diameter 5.7 mm (0.224 in.), neck diameter 6.43 mm (0.253 in.), shoulder diameter 9.0 mm (0.354 in.), base diameter 9.58 mm (0.377 in.), rim diameter 9.60 mm ( 0.378 in.), rim thickness 1.14 mm (0.045 in.), case length 44.70 mm (1.760 in.) and overall length 57.40 mm (2.260 in.) and wherein said middle portion has a length equal to about ⅓ the overall length of said bullet.

* * * * *